US008297888B2

(12) United States Patent
Voss

(10) Patent No.: US 8,297,888 B2
(45) Date of Patent: Oct. 30, 2012

(54) HYDRAULIC PROP COMPRISING THIN-WALLED EXTERIOR AND INTERIOR PIPES

(76) Inventor: Wolfgang Voss, Schwerte (DE)

( * ) Notice: Subject to any disclaimer, the term of this patent is extended or adjusted under 35 U.S.C. 154(b) by 442 days.

(21) Appl. No.: 12/450,901

(22) PCT Filed: Apr. 9, 2008

(86) PCT No.: PCT/DE2008/000598

§ 371 (c)(1),
(2), (4) Date: Oct. 16, 2009

(87) PCT Pub. No.: WO2008/125082

PCT Pub. Date: Oct. 23, 2008

(65) Prior Publication Data

US 2010/0119311 A1 May 13, 2010

(30) Foreign Application Priority Data

Apr. 17, 2007 (DE) ..... 10 2007 018 021

(51) Int. Cl.
*E21D 15/51* (2006.01)
*F16B 7/10* (2006.01)

(52) U.S. Cl. ..... 405/294; 403/109.4

(58) Field of Classification Search ..... 405/288, 405/290, 291, 293–295; 403/109.1–109.4, 403/109.7
See application file for complete search history.

(56) References Cited

U.S. PATENT DOCUMENTS 2,719,688 A * 10/1955 Seifert ..... 248/188.5

FOREIGN PATENT DOCUMENTS

DE 10229303 A1 * 10/2003

* cited by examiner

*Primary Examiner* — Tara Mayo-Pinnock
(74) *Attorney, Agent, or Firm* — James Creighton Wray

(57) ABSTRACT

A hydraulic prop 1 is provided for use in underground mining and tunnel construction and is to be used above all in the shield support. In this shield support or in the hydraulic prop 1, the exterior pipe 15 having the foot connection part 16 and the handle 17 and the interior pipe 19 having the head plate 20 are effectively connected together via spring steel wire ties 35 which are disposed or are to be disposed in corresponding connecting grooves 36, 37, 38 or 39, 40 41 such that in the transition region 42 sufficiently high forces can be transferred so as to ensure a connection between the components which is effective and remains effective. A setting pressure of 600 t can be realized at about 700 bar with the corresponding equipment. The connecting technique permits the use of high-strength thinner-walled pipes.

17 Claims, 5 Drawing Sheets

1
2
3
4
5
6
7
8
9
10
11
12

28
15
19
29
71
70
71'
69
75
42
40
34
27'
38
30
45
34
76
74
16

23

67
63
64
25
62
66
22
65
24

HYDRAULIC PROP COMPRISING THIN-WALLED EXTERIOR AND INTERIOR PIPES

This application claims the benefit of German Application No. 10 2007 018 021.9 filed Apr. 17, 2007 and PCT/DE2008/000598 filed Apr. 9, 2008, which are hereby incorporated by reference in their entirety.

The invention relates to an hydraulic prop for use in underground mining and tunnel construction, having an exterior pipe with an end-side foot connection part as well as a handle attached to the opposite pipe end, and having an interior pipe, designed to be displaceable in the exterior pipe, with an end-side head plate as well as an allocated filling/release valve, pressure-limiting valve and lock wires which are to be slid into connecting grooves for the exterior pipe, foot connection part and handle as well as the interior pipe and head plate.

Such hydraulic props are used as individual props and also in support frames and shield support frames. In order to actuate the cylinders, these props are influenced with a hydraulic fluid which can be oil, water, water in oil, plasma or even another fluid or even air. The water-oil emulsion used in underground mining and tunnel construction for safety reasons is firstly compressed in a high pressure pump and then supplied to the hydraulic prop or the cylinder via hose lines or the like. The extension and retraction of the hydraulic prop is controlled via valves, wherein operation is always effected at one and the same pressure, namely the pressure dependent upon the output of the high pressure pump, nowadays mostly about 360 bar. However, a higher pressure level is desired in particular in underground mining and tunnel construction. Since considerable weights already have to be managed with conventional interior and exterior pipes through the necessary wall thicknesses in the case of the current 360-400 bar, and also conventional pumps do not generate a higher pressure level, this has heretofore had to be left as is under the current conditions. It is known from DE 102 29 303.1 A1 to connect the exterior and interior pipes forming the hydraulic prop as well as the required additional parts such as the head plate, foot connection part and handle to each other via so-called lock wires. The lock wires which are used and which have a round cross-section render it possible, in the case of the design shown therein, to obviate the otherwise required welding work to connect these individual components. For this purpose, the round lock wires shown in this case can be slid into the identically formed connecting grooves in order to connect the individual components. These lock wires are preformed round wires consisting of spring steel which have a smaller diameter than conventional lock wires and can thus transfer high forces of up to approximately 40 t. Although two such lock wires are used in each case in the significantly loaded connecting regions, namely between the exterior pipe and the foot plate and between the interior pipe and the head plate in this Prior Art, the forces to be received and absorbed consequently do not become considerably higher.

The object of the invention is thus to create a thin-walled hydraulic prop which can thus be manipulated easily, is suitable for the maximum pressure range and can thus also be used with a setting pressure of approximately 600 t.

The object is achieved in accordance with the invention by virtue of the fact that the lock wires are formed as rectangular wire ties, preferably consisting of spring steel, which are designed to be able to be placed in a connecting groove, corresponding in width to the "spring steel wire ties", and to be able to be displaced from here into the transition region and thus into the opposite connecting groove, corresponding in width, and to connect the pipe parts together at this location.

The corresponding change in the cross-sections of these lock wires allows to create a spring steel wire tie, wherein although it can no longer be slid into said connecting groove, it can be placed in a corresponding connecting groove and can be slid from there into the connecting region to the other component in order to effect the required coupling or connecting work at that location. The rectangular spring steel wire is disposed such that it can withstand loads via the longer axis when connecting the individual components or upon their subsequent operation. It has been shown that very high forces can be received using such spring steel wire ties without the risk that the individual hydraulic prop components detach from each other or become detached from each other. On the contrary, setting pressures of up to approximately 600 t and more are accommodated or applied, i.e., when such a hydraulic prop is provided with a device via which the pressure within the cylinder is increased well beyond 400 bar, preferably to about 700 bar. Such a method and such a cylinder are known from DE 103 06 128 A1. However, above all it is now possible, owing to this connecting technique, to use pipes consisting of carbon steels which have a great deal of strength which means that thin-walled pipes can be used overall. Thin-walled pipes consisting of carbon steel are substantially lighter than previous pipes which can be welded. Such high-strength pipes have strengths of over 80 kg.

In accordance with an convenient embodiment of the invention, provision is made that the connecting groove accommodating the lock wire is formed in the head plate or in the handle and the foot connection part and the opposite connecting groove is allocated to the exterior pipe or the interior pipe. Thus, it is initially possible to place the relatively rigid spring steel wire tie or the corresponding lock wire into the connecting groove for example in the head plate, in the handle or in the foot connection part and then to insert the exterior pipe or interior pipe accordingly. Since the lock wire and thus the spring steel wire tie is located in its groove, the slide-in process cannot be hindered by the lock wire. Furthermore, the lock wire can now be influenced from the outside such that it is partially pressed into the connecting groove in the exterior pipe or interior pipe which means that the transition region between the two grooves is bridged and the connection is effectively produced. It is understood that the lock wire is fixed in this transition region, for which reason embodiments are presented further hereinafter.

In order to ensure the slide-in process which was described further above and to otherwise ensure that the lock wire is positioned precisely in the transition region, i.e., extending into the two grooves, the invention makes provision for the connecting groove accommodating the lock wire to have a depth which completely accommodates the lock wire whilst the opposite connecting groove has a depth corresponding to approximately 50% of the lock wire thickness. The lock wire can thus be slid into the opposite connecting groove only in a limited manner as described which means that it remains in the original groove with the other half so that the described connection between the two components is ensured. The lock wire is thus effectively prevented from being displaced to an excessive extent.

The displacement, which has already been described many times, of the lock wire from the accommodating connecting groove into the opposite connecting groove is effected in a simple and convenient manner by virtue of the fact that adjusting screws, which act upon the respective lock wire, are disposed over the periphery of the interior pipe envelope of the head plate and of the exterior pipe envelope of the foot connection part or of the handle. These adjusting screws can be actuated from the outer wall of the head plate or of the foot connection part and of the handle in order to move the lock wire uniformly from the accommodating connecting groove partially into the opposite connecting groove.

Since a closed ring cannot be used as the lock wire, since it changes its length upon displacement, it is ensured that the lock wire is manipulated securely and is simultaneously securely fixed in the "end position", in that in accordance with the invention the spaced interval between the adjusting screws on the lock wire ends is reduced, preferably halved. The lock wire is thus fixed and held all around without the lock wire ends, which protrude in some respects, being kept separate from the connecting effect. On the contrary, the entire lock wire is an advantageous secure connecting element.

In order to be able to screw-in the adjusting screws in a rapid and reliable manner and also to avoid protruding components, the invention makes provision for the adjusting screws to comprise a hexagon socket on the end opposite the support surface. The adjusting screw can thus be screwed completely into the corresponding bore and be used to effectively press the lock wire into the connecting position.

The rotating process or to be more precise the displacement process is facilitated by virtue of the fact that the support surface of the adjusting screws is formed to be slightly dished outwards which means that when screwing-in the adjusting screws, friction occurs which is advantageously reduced.

Reference has already been made further above to the fact that the connecting groove accommodating the spring steel wire tie and the opposite connecting groove have a corresponding width so that the spring steel wire tie or the lock wires can move in a problem-free manner, wherein this is further optimised in accordance with the invention by virtue of the fact that the lock wires comprise rounded edges. It is actually sufficient for the edges which face the opposite connecting groove to be rounded since it is only these edges which have to move into this connecting groove but slide automatically into the accommodating groove upon discharging.

Reference has already been made further above to the fact that setting loads of 600 t can be achieved, wherein this is particularly the case when the lock wires have of at least 100 kg and have a width of 15-20 mm, preferably 17 mm, at a height of 5-7 mm, preferably 6 mm. The selection of the corresponding width is particularly important in order to be able to safely absorb the required forces and to ensure the connection between the individual components of the hydraulic prop.

A method and a corresponding cylinder are known from DE 103 06 128 A1 and can be used to achieve the described pressure increases. In accordance with the present invention, such a so-called packer is integrated into the hydraulic prop, for which reason the invention makes provision for a so-called packer to be allocated to the head plate, which packer consists of a tensioning piston which is disposed so as to be displaceable in the piston rod and has a tensioning piston rod which can be slid into the cylinder chamber, wherein the hydraulic fluid can be additionally greatly compressed once more in the cylinder chamber via the tensioning piston. The head plate is to be correspondingly formed in order to securely accommodate the so-called packer and is also to be provided with the required connections in order to move the tensioning piston or tensioning piston rod such that a considerably increased pressure is generated in the cylinder chamber. It is understood that the hydraulic fluid is influenced with the known 360 or 400 bar even during the normal setting process which means that corresponding setting pressures are achieved. However, these are then brought to the further described level of about 600 t, in that the tension piston rod is pressed into the cylinder chamber in order to thus further pressurise the hydraulic fluid.

A switching device is required in order to actuate the hydraulic prop, i.e., for extending and clearing purposes, wherein the invention makes provision for a switching device having a pressure-limiting valve to be allocated to the exterior pipe via a releasable clamp. This design has the advantage that movements and influences of the connecting pipes on the exterior pipe have no effect on the fixing of the switching device. The releasable clamp permits limited movement in a problem-free manner without damage occurring as a result.

In accordance with the invention, provision is made for the clamp to comprise two half-shells which can be connected together via screws and to which the housing of the switching device and possibly of a second pressure-limiting valve provided for safety reasons is welded. Since the switching device, in particular the connecting parts to the pressure-limiting valves, can thus "move" in a limited manner with respect to the exterior pipe, damage cannot occur and the welds between the housing or even other components and the half-shells remain completely unaffected by vibrations which occur. However, above all the components can thus be securely connected to the pipes which cannot be welded and which are produced from high-strength steel.

The vibrations which possibly also have an effect on the components of the pressure-limiting valve also have no effect on this important component since in accordance with the invention provision is made for the pressure-limiting valve allocated to the switching device to have a flow regulator on the input-side. This flow regulator ensures that, upon actuation of the pressure-limiting valve, this valve remains free of vibrations owing to the hydraulic fluid flowing therethrough, which has a positive effect on the components of the pressure-limiting valve. No damage occurs in or on the pressure-limiting valve or on the hydraulic prop.

Since particularly high pressures are used, corresponding seals must be used. Particularly in the case of the moving components, but also in the case of the fixed components, it is advantageous if additional support rings consisting of metal are disposed in the grooves in which the seals allocated to the lock wires are disposed. This increases the service life of such seals and additionally safeguards the sealing process.

In order to avoid friction when sliding the interior pipe out of the exterior pipe, it is advantageous if a wide Teflon ring, disposed in a wide groove, is allocated to the two pipe ends of the interior pipe. Such a Teflon ring or the wide groove can have a length of 10 mm and more and considerably contribute to the fact that when sliding the interior pipe out of the exterior pipe and also when sliding it back in, no frictional losses occur, wherein simultaneously, in an advantageous manner, these Teflon rings additionally have a sealing effect.

The invention is particularly characterised in that a hydraulic prop has been created which can be used as an individual prop, but above all in the shield, wherein the individual parts are connected together without welding, and this using a technique which is easy to use and thus also optimally suited for the tough operation underground. Owing to the described connecting technique, the hydraulic props can be used with an extremely high setting pressure of up to 600 t and can thus, for the first time, completely satisfy the high requirements in present-day mining and tunnel construction underground. The hydraulic props consist of the interior pipe and the exterior pipe as well as the connecting parts to the bottom sill and to the top canopy of the, for example, travelling support frame. All of the parts are effectively connected as described merely via the lock wires of a particular construction without these connections being able to be damaged in the case of the high pressures and loads. Owing to this particular connecting technique, materials can be used which make the use of pipes having very thin walls (e.g., about 30 mm) possible. Above all, carbon steels have a great deal of strength and can be used here since any and all welding work has become superfluous. This is made possible above all owing to the rectangular spring steel wire tie which can be effectively used in correspondingly formed grooves in the connecting region between the components.

Further details and advantageous of the inventive subject matter will become apparent from the following description of the associated drawing, in which a preferred exemplified embodiment is illustrated with the details and individual parts required for that purpose. In the drawing:

DETAILED DESCRIPTION OF THE PREFERRED EMBODIMENTS

Figure 1:
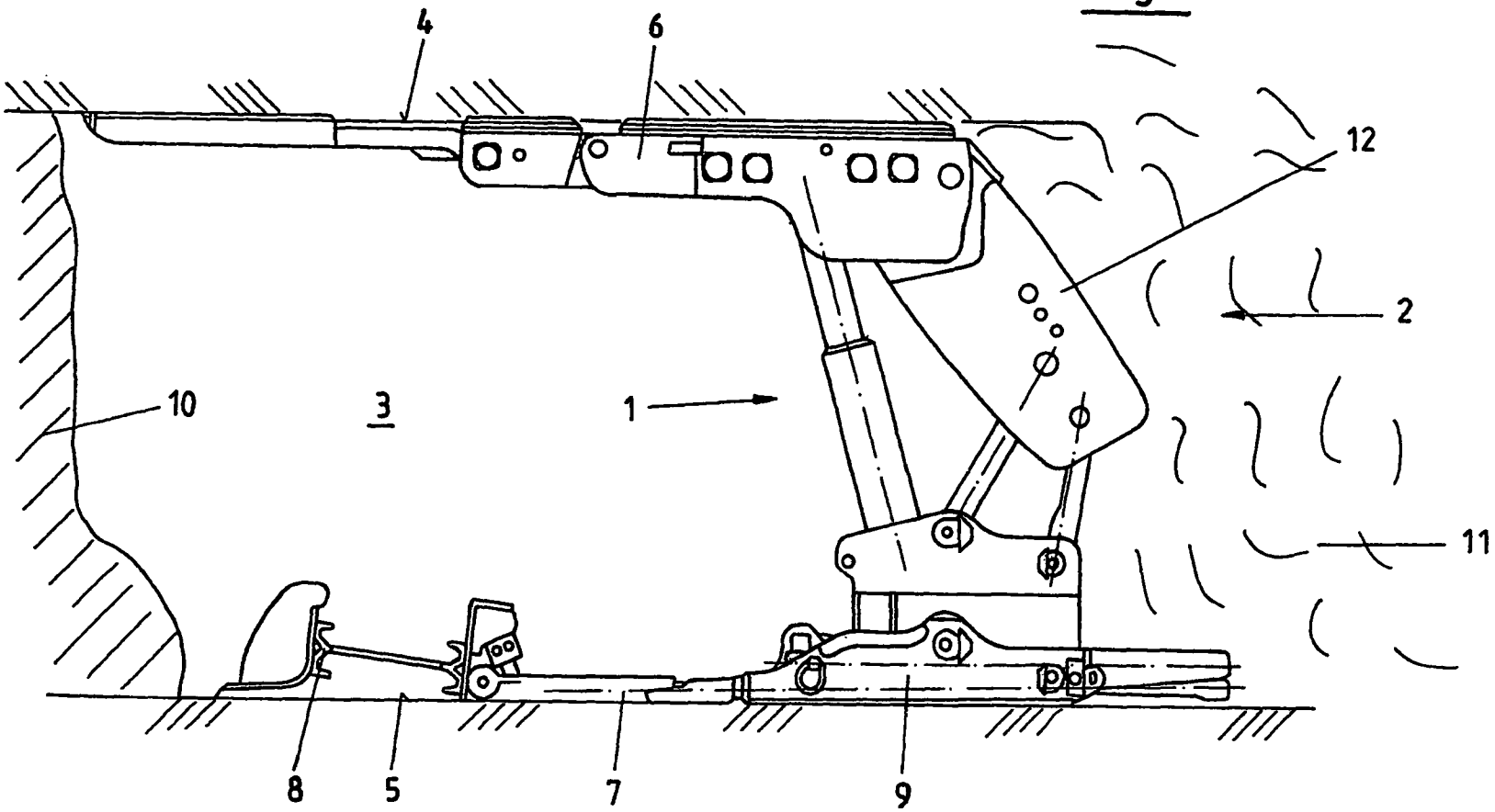
FIG. 1 shows a hydraulic prop, used in underground mining, in an hydraulic support.

FIG. 1 shows a hydraulic prop 1 used in underground mining and tunnel construction. It is part of the hydraulic support 2, in this case a shield support, which is used in the longwall 3 in order to support the roof 4 and the bottom 5 with respect to each other and thus to keep the created cavity open. The top canopy 6 is also formed in multiple parts, like the bottom sill 7, wherein a thrust cylinder 9 is incorporated in the bottom sill 7 and is used to be able to displace the face conveyor 8 in the direction of the coal face 10. The goaf 11 falls behind the shield support and then closes the created cavity, wherein the goaf shield 12 is engaged and supported such that whilst the hydraulic prop 1 is extended and also whilst it is retracted, there is always a sufficient degree of safety in the longwall 3.

Figure 2:
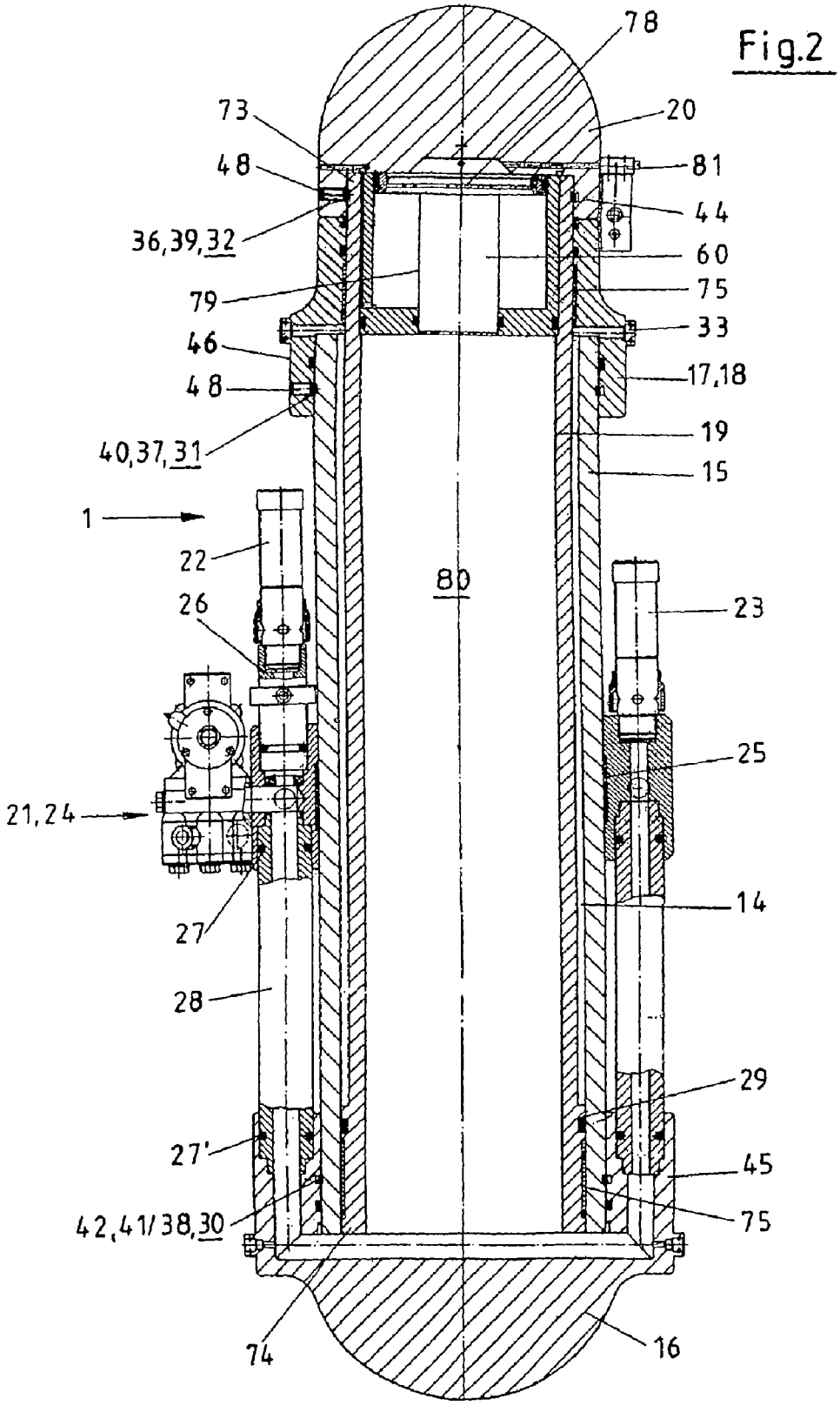
FIG. 2 shows a longitudinal sectional view of such a hydraulic prop.

FIG. 2 shows a longitudinal section through the hydraulic prop 1, wherein the exterior pipe is referenced with the numeral 15 and the interior pipe is referenced with the numeral 19. The exterior pipe 15 with the foot connection part 16 rests in the bottom sill 7 which is not illustrated in this Figure, whilst the handle 17 forms the upper end region of the exterior pipe 15. In the case of the shield support, the actual handle can be dispensed with, however a corresponding ring 18 is absolutely necessary and is simultaneously used as a slide-in limiting device for the interior pipe 19.

An annular chamber 14 is left between the exterior pipe 15 and the interior pipe 19 and is required to assist the sliding-in of the interior pipe 19. Further details in this regard will be explained further hereinafter.

At the pipe end 74, the interior pipe 19 is open with respect to the exterior pipe 15 so that during filling with hydraulic fluid via the filling/release valve 21 or the switching device 24 in the cylinder chamber 80 the interior pipe 19 is to be slid out of the exterior pipe 15. Thus, in the case of the support shown in FIG. 1, the top canopy 6 is pressed against the roof 4. The corresponding pressure then builds up in the cylinder chamber 80 and in the case of the design shown here can be built up to a setting pressure of up to about 600 t. The cylinder chamber 80 is closed at the top by the head plate 20 which is fixed to the pipe end 73 of the interior pipe 19. Further explanations regarding the connections will be provided further hereinafter.

Filling and also discharging is effected via the switching device 24, wherein in this case a pressure-limiting valve 22 having a flow regulator 26 is additionally provided. If, owing to overloading in the cylinder chamber 80, the pressure becomes too high there then this pressure-limiting valve 22 opens without the vibrations which possibly occur through the connecting pipe 28 being able to have a disadvantageous effect. The described flow regulator 26 prevents this. The switching device 24 and the pressure-limiting valve 22 are connected to the cylinder chamber 80 via a connecting pipe 28, wherein this connecting pipe 28 can be attached in a simple and secure manner via clamps 27, 27'. A safety pressure-limiting valve 23 is provided on the other side which is not absolutely necessary but can be used for safety reasons. This safety pressure-limiting valve 23 and also the housing 65 of the switching device 24 are fixed to the exterior pipe 15 via a releasable clamp 25.

As already mentioned, upon activation of the switching device 24 and the connecting pipe 28, the cylinder chamber 80 is filled with hydraulic fluid. If the interior pipe 19 is then to be subsequently retracted, i.e., the hydraulic prop 1 is to be discharged, this movement is assisted by influencing the slide-in accelerator connection 33 with hydraulic fluid. The hydraulic fluid then acts upon the piston 29 of the interior pipe 19 and ensures that the interior pipe 19 is rapidly retracted.

In order to connect the individual parts of the hydraulic prop 1, in this case lock wires 30, 31, 32 are used. All of the lock wires 30, 31, 32 are formed as rectangular spring steel wire ties 35. They are located in connecting grooves 36, 37, 38 and can be slid into the opposite connecting grooves 39, 40, 41 via adjusting screws 48, 49, 50, 51 so that they then bridge the transition region 42 and ensure that the corresponding components are effectively connected together.

The lock wire 30 is located in the connecting groove 38 and 41. The lock wire 31 is located in the connecting groove 37 and 40 and finally the lock wire 32 is located in the connecting groove 36 and 39. Since the corresponding connecting grooves are, of course, incorporated in opposite components, an interior pipe envelope 44 is provided for bearing the lock wire 32, an exterior pipe envelope 45 is provided for the lock wire 30 and a further exterior pipe envelope 46 is provided for the lock wire 31. In this manner, the various connecting grooves 36-41 can be incorporated in a favourable manner, wherein details in this respect can be seen in particular in FIGS. 3, 4 and 5.

In order to increase the setting pressure in the hydraulic prop 1, a tensioning piston 78 is incorporated in the region of the head plate 20 and can be moved or displaced in the piston rod 77 by means of its tensioning piston rod 79. The tensioning piston rod 79 is slid into the cylinder chamber 80 in order thus to effect the pressure increase. The tensioning piston connection is referenced with the numeral 81 and is used to thus urge hydraulic fluid into the region above the tensioning piston 78.

Figure 3:
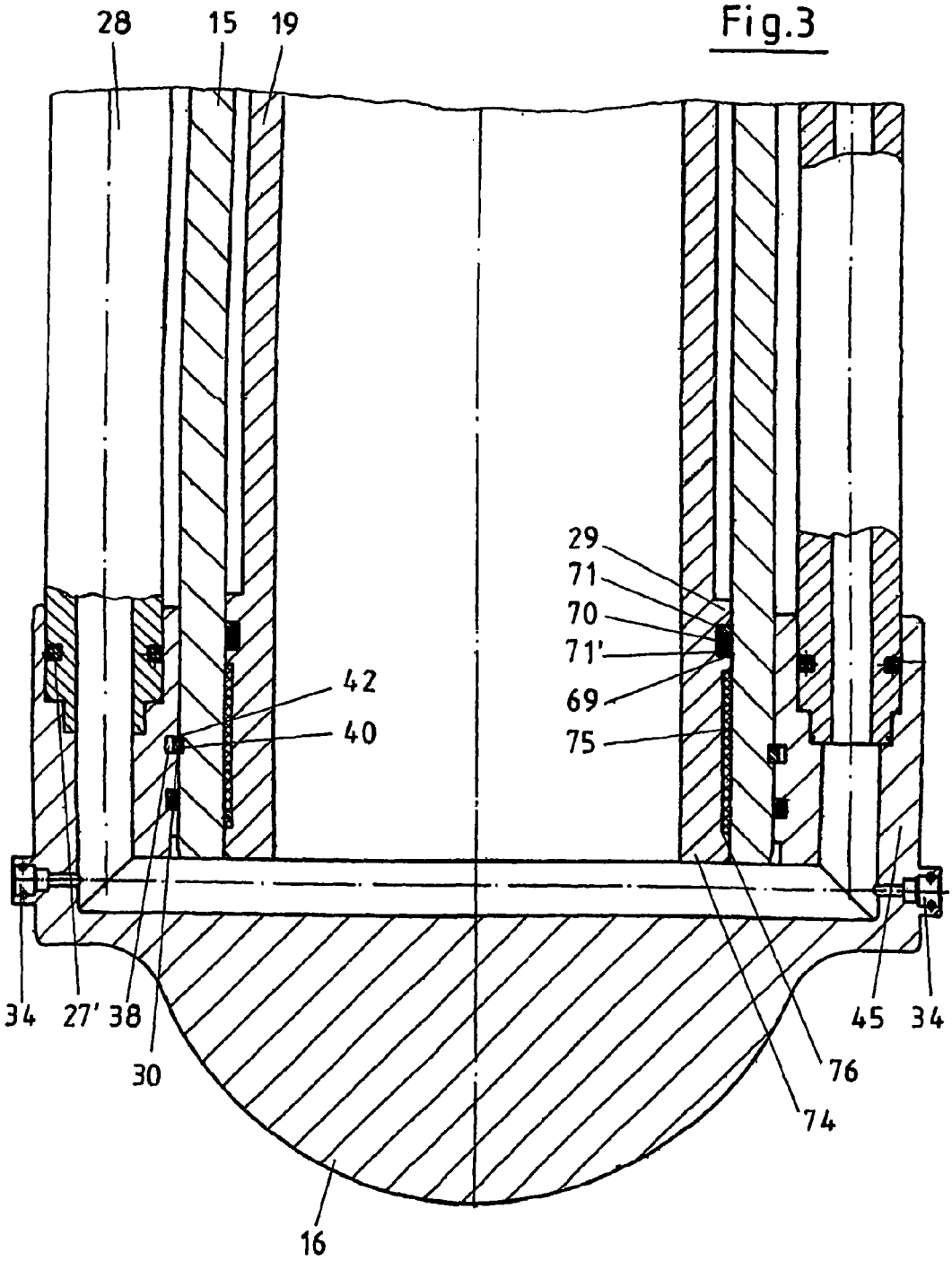
FIG. 3 shows an enlarged illustration of the connecting region to the bottom sill.

FIG. 3 shows an enlarged illustration of the foot connection part 16 inserted into the bottom sill 7. It can be seen here that the lock wire 30 is brought into a position which allows it to partly extend into the connecting groove 40 and also the connecting groove 38. It thus bridges the transition region 42 and ensures that the exterior pipe envelope 45 is effectively connected to the exterior pipe 15 at this location. Test connections are referenced with the numeral 34 in this Figure and are used to check and monitor the pressure ratios in the cylinder chamber 80. A Teflon ring 75 is provided at the lower pipe end 74 and rests in a wide groove 76. This wide Teflon ring 75 ensures that no frictional losses occur. It also simultaneously provides a sealing effect. A similarly formed Teflon ring is also provided at the pipe end 73 and is likewise referenced with the numeral 75.

Furthermore, a sealing ring 70 is disposed above this Teflon ring 75 in the wide groove 76 and is fixed on both sides by a support ring 71, 71'. This sealing ring 70 rests with the support rings 71, 71' in a groove 69.

Figure 4:
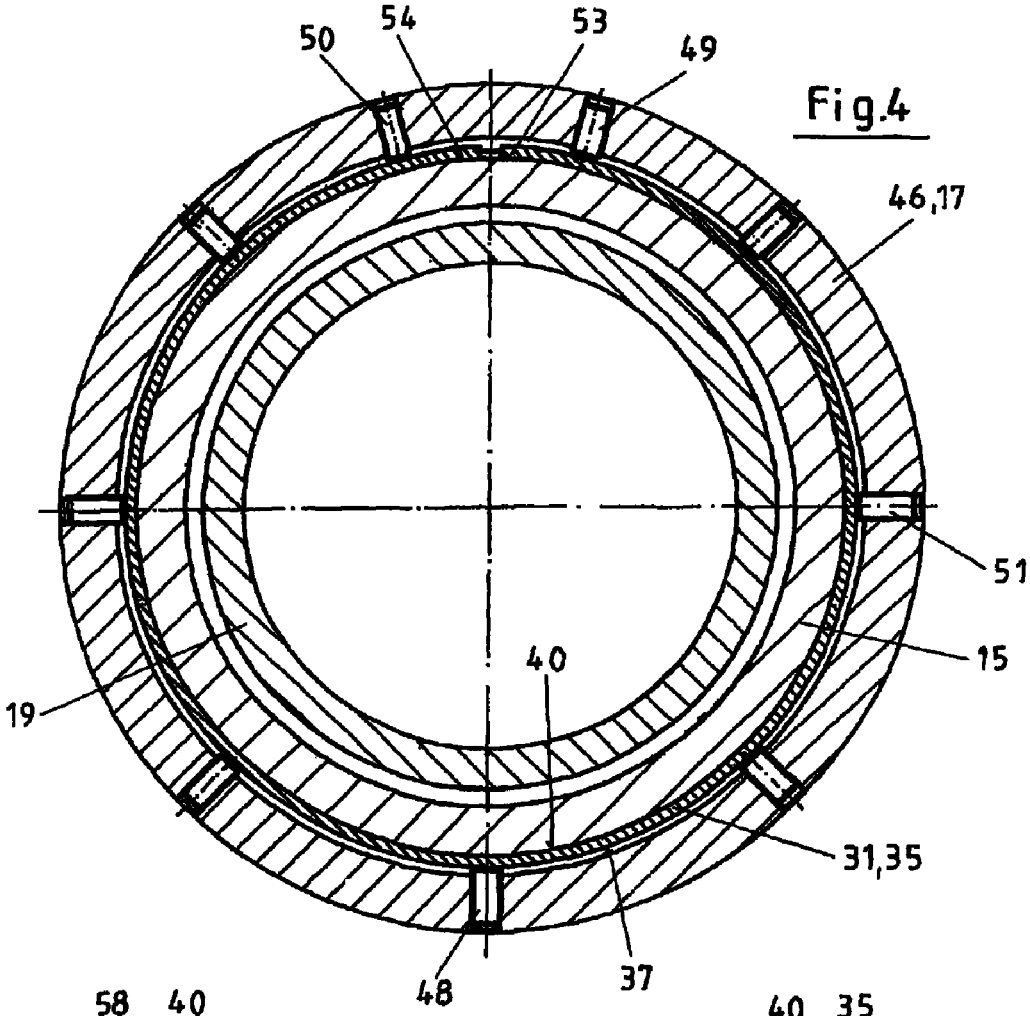
FIG. 4 shows a cross-section through the hydraulic prop in the connecting region of the so-called handle.

The arrangement and formation of the connecting regions to the spring steel wire ties 35 in the form of the lock wires 30, 31, 32 is shown in more detail in FIG. 4 and FIG. 5. FIG. 4 illustrates a section which shows the exterior pipe envelope 46 and also the exterior pipe 15 and the interior pipe 19. The exterior pipe 15 and the exterior pipe envelope 46 of the handle 17 are fixed or connected here. The lock wire 31 connecting the two components together has, in this Figure, already been slid out of the groove 37 accommodating the lock wire 31 partly into the groove 40 and furthermore by way of the adjusting screws 48, 49, 50 and 51. These adjusting screws 48-51 uniformly influence the lock wire 31, wherein in an convenient manner the adjusting screw 48 is used first. The more closely placed adjusting screws 49, 50 are then lastly rotated from their outer position into the fixing position, wherein they then fix the lock wire ends 53, 54. These lock wire ends 53, 54 move towards each other upon being fixed or displaced within the connecting grooves 37, 40 without contacting each other. This illustration in FIG. 4 clearly shows how these supporting lock wires 30, 31, 32 can be moved to their connecting position and fixed there in a secure and rapid manner.

Figure 5A:
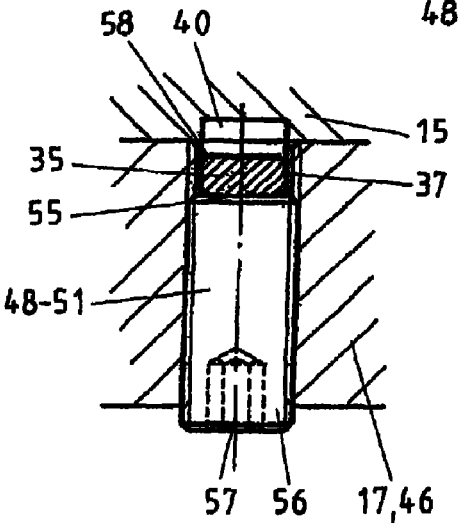
FIGS. 5A and 5B show an enlarged illustration of the transition region between the connecting grooves in the components to be connected, the initial position being shown on the left and the connecting position being shown on the right
Figure 5B:
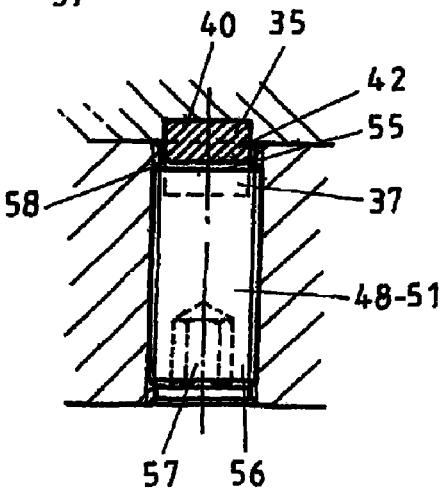

FIGS. 5A and 5B show on the left-hand side the initial position of the spring steel wire tie 35, wherein the adjusting screw 48 or 49 or 50 or 51 is located in a position which ensures that the lock wire 30, 31, 32 or the spring steel wire tie 35 is not an obstacle when sliding for example the exterior pipe 15 into the handle 17. It is located completely in the connecting groove 37 accommodating it. In order to effectively connect the two components, i.e., the handle 17 to the exterior pipe 15, the adjusting screw 48, 49, 50, 51 is then slid from the connecting groove 37 into the connecting groove 40 via the hexagon socket 57 on the opposite end of the support surface 55 and furthermore so that it completely fills this groove but still protrudes in the transition region 42 into the remaining opening of the connecting groove 37. The two components are effectively connected together in this manner.

The support surface 55 is slightly curved outwards in the direction of the spring steel wire tie 35 and the edges 58 of the spring steel wire tie 35 are slightly rounded in order to facilitate and secure the insertion into the connecting groove 40.

Reference has already been made above to the position of the packer 60 in the region of the head plate 20. The designation "packer" should clearly indicate that a considerable pressure increase is produced in this location.

Figure 6:
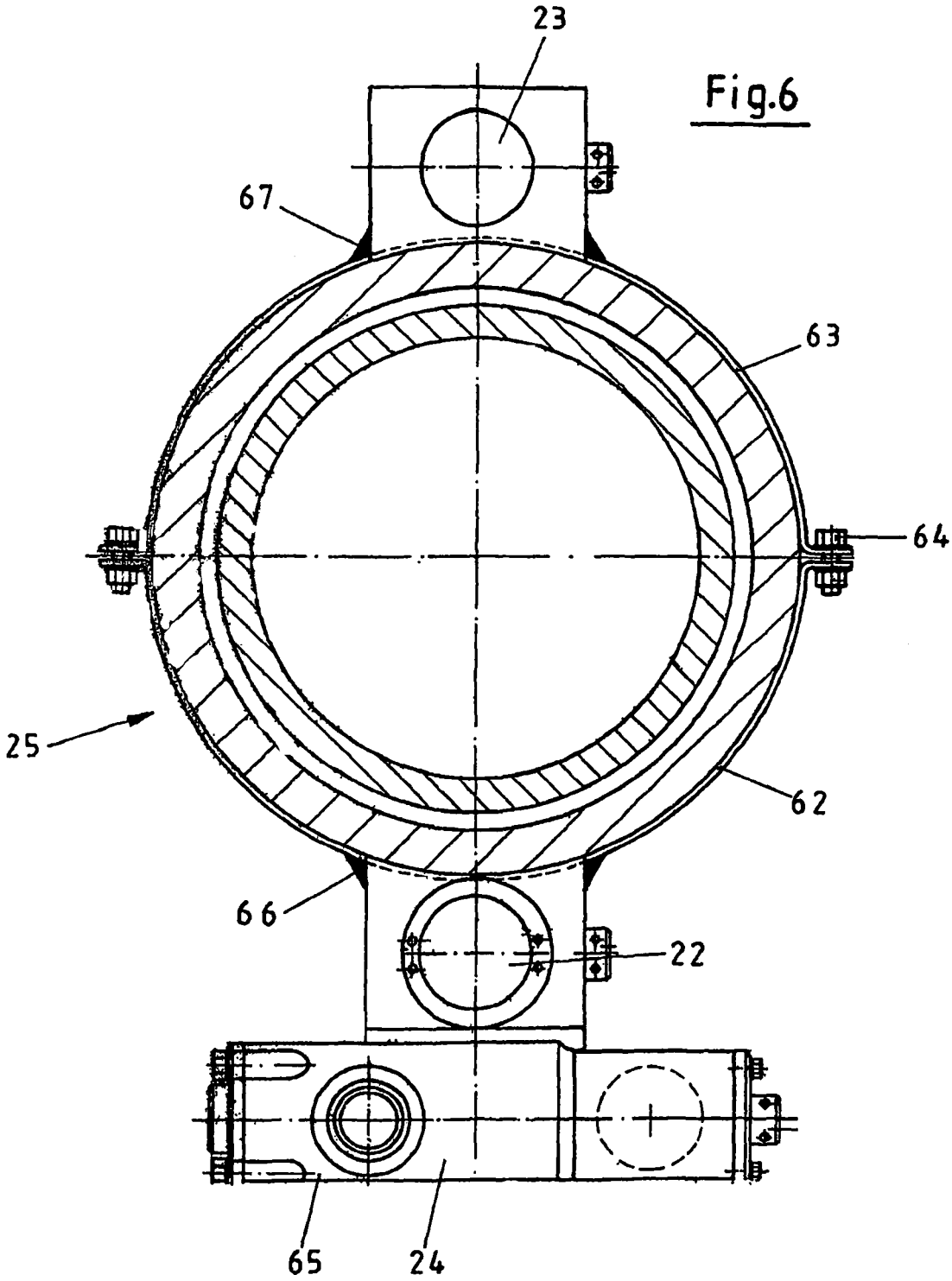
FIG. 6 shows a cross-section through the hydraulic prop in the region of the connection for the switching device and the pressure-limiting valves.

Finally, FIG. 6 shows the connection of the switching device 24 or the pressure-limiting valves 22, 23 to the exterior pipe 15. In order to ensure that the vibrations which possibly occur in particular through the connecting pipes 28 do not have a damaging effect on this fixation to the exterior pipe 15, these components are connected together via a releasable clamp 25. In addition, the use of high-strength pipes which cannot be welded is thus supported. This releasable clamp 25 consists of two half-shells 62, 63 which are to be connected together via screws 64. The housing 65 or even the pressure-limiting valve 22, 23 are fixed to this releasable clamp 25 via welds 66, 67 so that any occurring movements or the like do not have an effect on the connection to the exterior pipe 15.

All of the stated features and also those which can be seen alone in the drawings, are considered as essential to the invention, both alone and in combination.

The invention claimed is:

1. A hydraulic prop for the use in underground mining and tunnel construction, having an exterior pipe (15) with an end-side foot connection part (16) as well as a handle (17) attached to the opposite pipe end, and having an interior pipe (19) which is designed to be displaceable in the exterior pipe (15) and has an end-side head plate (20) and an allocated filling/release valve (21), pressure-limiting valve (22) and lock wires (30) to be slid into connecting grooves (36) for the exterior pipe (15), foot connection part (16) and handle (17) as well as the interior pipe (19) and head plate (20), wherein the lock wires (30, 31, 32) are formed as rectangular wire ties (35) of spring steel, which are designed to be able to be placed in a connecting groove (36, 37, 38), corresponding in width to the wire ties (35), and to be able to be displaced from here into a transition region (42) and thus into an opposite connecting groove (39, 40, 41), corresponding in width to the wire ties, and to connect the pipes together at this location.

2. The hydraulic prop as claimed in claim 1, wherein the connecting groove (36, 37, 38) accommodating the lock wires (30, 31, 32) is formed in the head plate (20) or in the handle (17) and the foot connection part (16) and the opposite connecting groove (39, 40, 41) is allocated to the exterior pipe (15) or the interior pipe (19).

3. The hydraulic prop as claimed in claim 1, wherein the connecting groove (36, 37, 38) accommodating the lock wires (30, 31, 32) has a depth completely accommodating the lock wires (30, 31, 32) whilst the opposite connecting groove (39, 40, 41) is designed to have a depth which corresponds to approximately 50% of the lock wires thicknesses.

4. The hydraulic prop as claimed in claim 1, wherein adjusting screws (48, 49, 50, 51) which act upon the respective lock wire (30, 31, 32) are disposed over the periphery of an interior pipe envelope (44) of the head plate (20) and of an exterior pipe envelope (45, 46) of the foot connection part (16) or of the handle (17).

5. The hydraulic prop as claimed in claim 4, wherein a spaced interval between two of the adjusting screws (49, 50) near the lock wire ends (53, 54) is reduced with respect to spaced intervals between other of the adjusting screws.

6. The hydraulic prop as claimed in claim 4, wherein the adjusting screws (48, 49, 50, 51) comprise hexagon sockets (57) on ends (56) opposite support surfaces (55).

7. The hydraulic prop as claimed in claim 6, wherein the support surfaces of the adjusting screws are formed slightly curved outward.

8. The hydraulic prop as claimed in claim 4, wherein a spaced interval between two of the adjusting screws (49, 50) near the lock wire ends (53, 54) is halved with respect to spaced intervals between other of the adjusting screws.

9. The hydraulic prop as claimed in claim 1, wherein the lock wires (30, 31, 32) comprise rounded edges (58).

10. The hydraulic prop as claimed in claim 1, wherein the lock wires (30, 31, 32) have a strength of at least 100 kg and have a width of 15-20 mm, 17 mm at a height of 5-7 mm.

11. The hydraulic prop as claimed in claim 10, wherein the lock wires have a height of 6 mm.

12. The hydraulic prop as claimed in claim 1, wherein a packer (60) is allocated to the head plate (20) and consists of a tensioning piston (78) which is disposed so as to be displaceable in a piston rod (77) and has a tensioning piston rod (79) which can be slid into the cylinder chamber (80), wherein the hydraulic fluid can be additionally compressed in the cylinder chamber (80) via the tensioning piston (78).

13. The hydraulic prop as claimed in claim 1, wherein a switching device (24) having a pressure-limiting valve (22) is allocated to the exterior pipe (15) via a releasable clamp (25).

14. The hydraulic prop as claimed in claim 13, wherein the clamp (25) comprises two half-shells (62, 63) which can be connected together via screws (64) and to which a housing (65) of the switching device (24) and possibly of a second pressure-limiting valve (23) provided for safety reasons is welded.

15. The hydraulic prop as claimed in claim 13, wherein the pressure-limiting valve (22) allocated to the switching device (24) has a flow regulator (26) on the input-side.

16. The hydraulic prop as claimed in claim 1, wherein support rings (71) consisting of metal are disposed in grooves (69) in which seals (70) allocated to the lock wires (30, 31, 32) are disposed.

17. The hydraulic prop as claimed in claim 1, wherein a wide polytetrafluoroethylene ring (75), disposed in a wide groove (76), is allocated to each of the two pipe ends (73, 74) of the interior pipe (19).

* * * * *